US005714921A

United States Patent [19]

Aoki

[11] Patent Number: 5,714,921

[45] Date of Patent: Feb. 3, 1998

[54] DEFLECTION YOKE

[75] Inventor: Kyosuke Aoki, Kanagawa, Japan

[73] Assignee: Sony Corporation, Tokyo, Japan

[21] Appl. No.: 685,635

[22] Filed: Jul. 24, 1996

[51] Int. Cl.[6] ..... H01J 29/70

[52] U.S. Cl. ..... 335/213; 335/210; 313/440

[58] Field of Search ..... 335/210–214; 313/440; 348/829, 830, 831

[56] References Cited

U.S. PATENT DOCUMENTS

| | | | |
|---|---|---|---|
| 4,175,261 | 11/1979 | Sawada | 335/210 |
| 4,755,714 | 7/1988 | Sluyterman | 313/440 |
| 4,789,806 | 12/1988 | Meershoek | 313/440 |
| 4,823,046 | 4/1989 | Sluyterman | 313/431 |
| 5,225,737 | 7/1993 | Sato | 313/440 |

*Primary Examiner*—Michael L. Gellner
*Assistant Examiner*—Raymond Barrera
*Attorney, Agent, or Firm*—Jay H. Maioli

[57] ABSTRACT

A horizontal coil separator has a plurality of ribs for positionally controlling turns of a magnet wire, the ribs project successively stepwise in an axial direction of a cathode-ray tube. The turns of the magnet wire are bent over at respective positions staggered in the axial direction of the cathode-ray tube, depending on the winding position of the magnet wire as determined by the ribs. The ribs have fingers disposed on distal ends thereof for positionally controlling only opposite ends of the turns of the magnet wire.

2 Claims, 3 Drawing Sheets

DEFLECTION YOKE

BACKGROUND OF THE INVENTION

The present invention relates to a deflection yoke, and more particularly to a deflection yoke suitable for forming horizontal deflection coils as sectionalized saddle-shaped windings.

Deflection yokes for use in cathode-ray tube devices such as computer display units have horizontal deflection coils formed as sectionalized windings for minimizing poor aspects of convergence characteristics.

Specifically, a deflection yoke for use in cathode-ray tube devices for consumer type display units is manufactured by winding a self-fusion-type magnet wire on a die to produce a saddle-shaped horizontal deflection coil and then attaching the horizontal deflection coil to a separator, thereby forming a horizontal deflection coil assembly. On the other hand, a deflection yoke for use in computer display units is manufactured by winding a magnet wire directly on a separator to produce a horizontal deflection coil, thereby forming a horizontal deflection coil assembly.

The separator is substantially funnel-shaped and has a plurality of protrusions which project vertically upwardly and then spread radially. These protrusions are selectively used in forming a saddle-shaped horizontal deflection coil as sectionalized windings.

The deflection yoke also has a pair of vertical deflection form coils by winding magnet wires on a core. The core comprises a ferrite core that is divided by a hypothetical plane including the central axis of a substantially conical shape so that the vertical deflection coils will assume such a substantially conical shape when assembled together.

To assemble the deflection yoke, the vertical deflection coils are placed around the horizontal deflection coil assembly, and thereafter front and rear covers are attached. Then, the vertical deflection coils and the horizontal deflection coil are connected, and finally adjusted.

When winding the self-fusion-type magnet wire to produce the saddle-shaped horizontal deflection coil, variations of the winding distribution of the horizontal deflection coil are reduced to minimize poor aspects of convergence characteristics.

If the vertical deflection coils are also formed as sectionalized saddle-shaped windings, then it will be possible to reduce variations of the winding distribution of the vertical deflection coils, thereby achieving a further reduction of variations of the convergence characteristics of the deflection yoke.

For forming the vertical deflection coils formed as sectionalized saddle-shaped windings, a substantially funnel-shaped separator is prepared, and a magnet wire is wound on the substantially funnel-shaped separator to produce a substantially funnel-shaped vertical deflection coil assembly as a sectionalized winding in the same manner as the horizontal deflection coil assembly.

After the vertical deflection coil assembly is fabricated, the horizontal deflection coil assembly is inserted into the vertical deflection coil assembly, thus assembling a deflection yoke. Specifically, the neck of the horizontal deflection coil assembly is inserted into the substantially funnel-shaped vertical deflection coil assembly through the front end opening thereof.

Since the related art horizontal deflection coil assembly has a relatively large outside diameter at the neck thereof, if the horizontal deflection coil assembly is inserted in the vertical deflection coil assembly, then the vertical deflection coil assembly will be spaced from the neck of the cathode-ray tube when the deflection yoke is installed on the cathode-ray tube.

With the vertical deflection coil assembly being spaced from the neck of the cathode-ray tube, however, the sensitivity with which a magnet wire field is vertically deflected by the vertical deflection coil assembly is lowered, and the vertical deflection coil assembly requires a correspondingly large deflecting current. The large deflecting current results in an increase in the amount of electrical energy consumed by the deflection yoke and hence an increase in the temperature of the deflection yoke. As a consequence, the deflection yoke and the cathode-ray tube device suffer a reduction in the reliability in operation.

The core is also spaced from the horizontal deflection coil, which also suffers a reduction in the sensitivity with which it horizontally deflects a magnet wire field. Therefore, the horizontal deflection coil also requires a correspondingly large deflecting current.

SUMMARY OF THE INVENTION

It is therefore an object of the present invention to provide a deflection yoke which allows a vertical deflection coil and a core to be positioned near the neck of a cathode-ray tube which supports a vertical deflection coil assembly and a horizontal deflection coil assembly that is inserted in the vertical deflection coil assembly.

According to the present invention, there is provided a deflection yoke for use on a cathode-ray tube, comprising a vertical deflection coil assembly and a horizontal deflection coil assembly inserted in the vertical deflection coil assembly, the horizontal deflection coil assembly comprising a substantially funnel-shaped horizontal coil separator and a horizontal deflection coil wound as a sectionalized winding on the substantially funnel-shaped horizontal coil separator, the substantially funnel-shaped horizontal coil separator having a plurality of ribs extending along an inner wall surface thereof in an axial direction of the cathode-ray tube, the horizontal deflection coil being positionally controlled by the ribs, the ribs projecting stepwise along the inner wall surface of the substantially funnel-shaped horizontal coil separator toward a neck of the cathode-ray tube such that the rib which is positioned centrally of the horizontal deflection coil projects a largest distance, the ribs having fingers disposed on respective distal ends thereof and extending radially outwardly.

The deflection yoke may be fabricated as follows: After the vertical deflection coil assembly is fabricated by winding a vertical deflection coil as a sectionalized winding on a substantially funnel-shaped unitary vertical coil separator, the substantially funnel-shaped horizontal coil separator with the horizontal deflection coil wound thereon is inserted into the substantially funnel-shaped unitary vertical coil separator through a front end opening thereof.

The substantially funnel-shaped unitary vertical coil separator may have a substantially conical unitary core held therein, the vertical deflection coil being wound on the core.

The ribs for positionally controlling the horizontal deflection coil project stepwise along the inner wall surface of the substantially funnel-shaped horizontal coil separator toward the neck of the cathode-ray tube such that the rib which is positioned centrally of the horizontal deflection coil projects a largest distance. Turns of the horizontal deflection coil are thus bent over at respective positions staggered in the axial direction of the cathode-ray tube, depending on the winding position of the horizontal deflection coil, by the ribs. The ribs have fingers disposed on distal ends thereof for positionally controlling only opposite ends of the turns of the horizontal deflection coil.

If the horizontal coil separator with the horizontal deflection coil wound thereon is inserted into the vertical coil separator with the vertical deflection coil wound as a sectionalized winding, through the front end opening of the vertical coil separator, then the vertical coil separator may have a relatively small inside diameter.

If the substantially funnel-shaped unitary vertical coil separator has the substantially conical unitary core held therein with the vertical deflection coil wound thereon, then the inside diameter of the core may be relatively small.

DETAILED DESCRIPTION OF THE PREFERRED EMBODIMENTS

Figure 1:
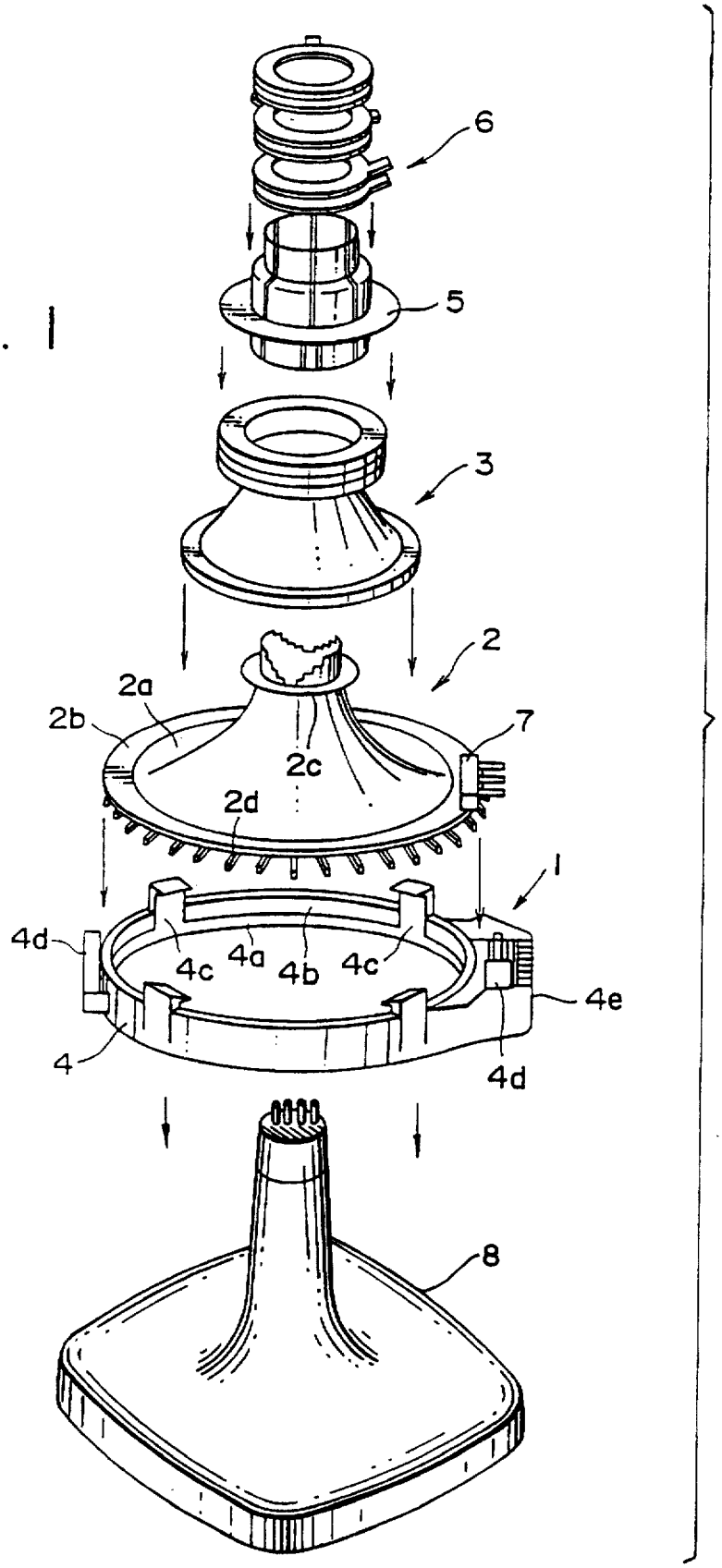
FIG. 1 is an exploded perspective view of a deflection yoke according to the present invention.

FIG. 1 shows in exploded perspective a deflection yoke 1 according to the present invention. The deflection yoke 1 shown in FIG. 1 is manufactured as follows: first, a horizontal deflection coil assembly 2 and a vertical deflection coil assembly 3 are produced in respective horizontal and vertical coil winding processes. Then, the horizontal deflection coil assembly 2, the vertical deflection coil assembly 3, a front cover 4, and a rear cover 5 are coaxially combined with each other.

The front cover 4 comprises a ring-shaped front cover member **4*a* covering a front surface of the deflection yoke 1, and a cylindrical wall 4*b* extending axially from a circumferential edge of the front cover member 4*a* in surrounding relation to the front end of the deflection yoke 1. The front cover 4 has four hooks 4*c* projecting axially from the cylindrical wall 4*b* and engaging a circular flange 2*b* extending around a front surface of the horizontal deflection coil assembly 2, so that the front cover 4 is securely retained on the horizontal deflection coil assembly 2**.

The front cover 4 has a storage area **4*d* for storing a pincushion-shaped picture distortion correcting magnet. If necessary, such a pincushion-shaped picture distortion correcting magnet is held in the storage area 4*d*. The cylindrical wall 4*b* includes a radially outward bulge 4*e* for receiving a terminal plate 7 of the horizontal deflection coil assembly 2**.

An image-quality correcting magnet 6 for correcting an image quality such as color purity or the like is mounted on the rear cover 5 by bands.

After the rear cover 5 and the front cover 4 are assembled, respectively, the horizontal deflection coil assembly 2 and the vertical deflection coil assembly 3 are assembled together, and then the rear cover 5 and the front cover 4 are installed in position. Therefore, the deflection yoke 1 can easily be assembled and installed on the cathode ray tube 8.

The vertical deflection coil assembly 3 is fabricated by winding a magnet wire as a sectionalized saddle-shaped winding on a substantially funnel-shaped vertical coil separator. Specifically, a unitary conical core (hereinafter referred to as an "undivided core") is placed in the vertical coil separator, and the magnet wire is wound using protrusions on front and rear ends of the vertical coil separator. Since the undivided core is placed in the vertical coil separator and the magnet wire is wound on the vertical coil separator, a vertical deflection coil can be positioned in the vicinity of the undivided core for increased deflection sensitivity.

Cores for use in the winding of coils are made of sintered ferrite. Therefore, such cores tend to shrink largely to different degrees when they are sintered. The related art divided ferrite cores are thus liable to suffer distortions and poor dimensional accuracy. Accordingly, deflection yokes that are fabricated using the related art divided ferrite cores have greatly different convergence characteristics due to such distortions and poor dimensional accuracy of the related art divided ferrite cores.

The undivided core, however, does not suffer large distortions and poor dimensional accuracy because it shrinks uniformly when sintered. Inasmuch as the vertical deflection coil assembly 3 is fabricated using the undivided core, any variations of the characteristics of the vertical deflection coil assembly 3, which would otherwise be caused by the core, are minimized.

Furthermore, the vertical coil separator has a holder mechanism for holding the undivided core therein in coaxial alignment with the vertical coil separator. Consequently, any variations of the characteristics of the vertical deflection coil assembly 3, which would otherwise be caused by misalignment of the undivided core, are also minimized.

If the related art horizontal deflection coil assembly were combined with the vertical deflection coil assembly 3 which is fabricated using the undivided core, then it would be necessary to increase the inside diameter of the core, and the core would be spaced from horizontal deflection coils by a corresponding distance, resulting in a reduction in the sensitivity with which a magnet wire field is horizontally deflected by the horizontal deflection coil assembly. The vertical deflection coil positioned inside the undivided core is spaced from the neck of the cathode-ray tube 8, also resulting in a reduction in the sensitivity with which a magnet wire field is vertically deflected by the vertical deflection coil assembly.

The horizontal deflection coil assembly 2 comprises a pair of confronting horizontal deflection coils which are formed as sectionalized saddle-shaped windings by winding magnet wires on a horizontal coil separator **2*a*. The horizontal coil separator 2*a* is of a substantially funnel-shaped unitary structure and has flanges 2*b*, 2*c*** on respective front and rear ends thereof.

The flange **2*b* on the front end has a plurality of protrusions 2*d* spaced at certain angular intervals and projecting at a right angle from the flange 2*b* and then bent radially outwardly. The magnet wires extending along an inner edge of the horizontal coil separator 2*a* engage the protrusions 2*d***, which control the position where the magnet wires are wound for effectively avoiding irregularities in the winding distribution.

Figure 2:
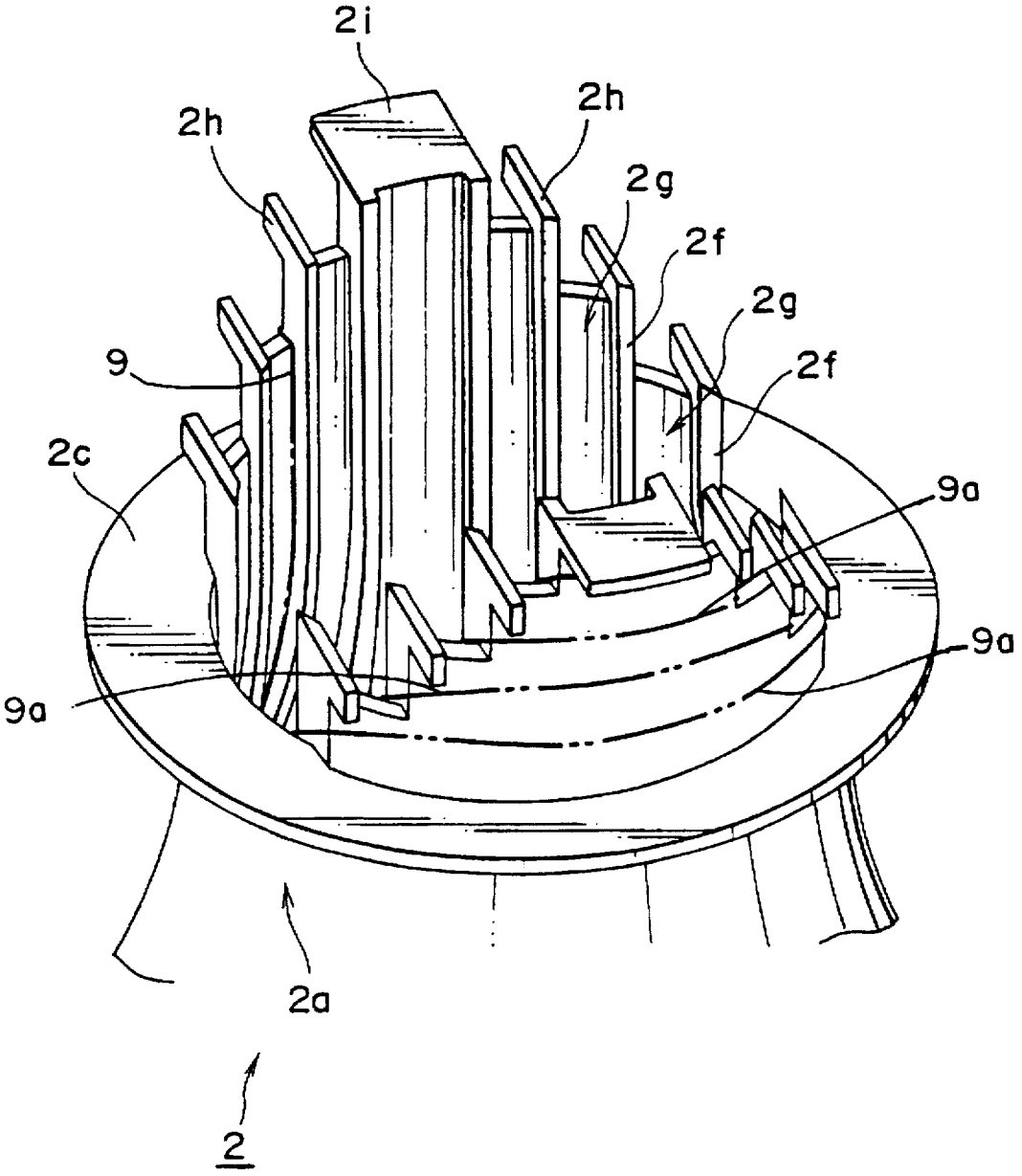
FIG. 2 is an enlarged fragmentary perspective view of a bent section of a horizontal deflection coil assembly of the deflection yoke shown in FIG. 1.

As shown in FIG. 2, the horizontal coil separator **2*a* has a plurality of ribs 2*f* extending along an inner wall surface thereof in the axial direction of the cathode-ray tube, the ribs 2*f* defining therebetween a plurality of grooves 2*g* in the inner wall surface. The magnet wires are held in position by being placed in some of the grooves 2*g*. Therefore, irregularities in the winding distribution on the inner wall surface of the horizontal coil separator 2a are also effectively avoided by the grooves 2g which hold the magnet wires. The magnet wires of the horizontal deflection coils are partly represented by the dash-and-dot lines 9 and the dash-and-two-dot lines 9 in FIG. 2**.

The ribs 2f and an inner wall surface of the flange 2c extend upwardly (as viewed in FIG. 2) along the outer wall surface of the cathode-ray tube at the rear end of the horizontal coil separator 2a, that is, the bent section of the horizontal deflection coil assembly 2. With the ribs 2f thus extending upwardly, the grooves 2g also extend at the rear end of the horizontal coil separator 2a. The ribs 2f project on the flange 2c successively stepwise in facing relation to the confronting pair of the horizontal deflection coils. Those grooves 2g which correspond to the respective centers of the horizontal deflection coils project the largest distance at the rear end of the horizontal coil separator 2a.

Therefore, the more inwardly of each of the horizontal deflection coils the magnet wires in the grooves 2g are positioned, the greater the distance the magnet wires extend at the rear end of the horizontal coil separator 2a. The magnet wires in the corresponding grooves 2g extend from the grooves 2g, then run outside of the ribs 2f along the flange 2c, and run again in the corresponding grooves 2g on the inner wall surface of the horizontal coil separator 2a. In the bent section of the horizontal deflection coil assembly 2, those magnet wires which extend around the cathode-ray tube are bent over at respective positions staggered in the axial direction of the cathode-ray tube, depending on the position where the magnet wires are wound.

The magnet wires 9,9 which are thus bent over at respective staggered positions are less protruding radially of the deflection yoke 1 than the magnet wires of the related art horizontal deflection coil assembly which are bent over at the same position in the axial direction of the cathode-ray tube. In the deflection yoke 1, therefore, the vertical deflection coil assembly 3 and the undivided core are positioned in the vicinity of the horizontal deflection coil assembly 2.

The ribs 2f have respective 90°-bent fingers 2h on their distal ends which serve to control the positions of the opposite ends of the turns of the magnet wires which are bent over and extend around the cathode-ray tube. The ribs 2f which extend the largest distance at the rear end of the horizontal coil separator 2a are joined to each other by a plate 2i extending therebetween, thereby controlling the position of the corresponding magnet wire.

Each of the magnet wires of the horizontal deflection coils generally comprises a so-called litz wire composed of a plurality of fine separately insulated strands woven together. The litz wire cannot easily be deformed even if it is wound under tension. If the ribs 2f were free of the fingers 2h, then the litz wire running around the cathode-ray tube would possibly be dislodged off the ribs 2f.

The fingers 2h and the plate 2i are effective to prevent the magnet wire from being dislodged off the ribs 2f. Specifically, the ribs 2f have respective fingers 2h except for those ribs 2f which extend the largest distance at the rear end of the horizontal coil separator 2a, and those fingers 2h control the positions of the magnet wires extending around the cathode-ray tube, only at the opposite ends of the turns of the magnet wire wires, for effectively preventing the magnet wire wires from being dislodged off the ribs 2f.

Figure 3:
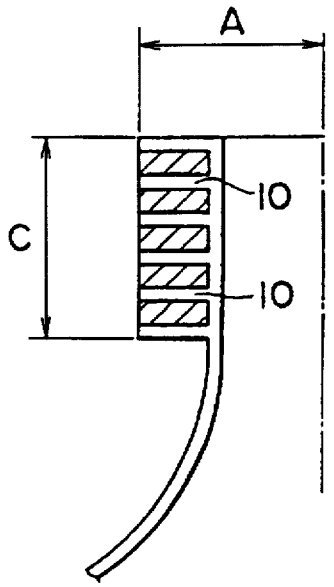
FIG. 3 is an enlarged fragmentary cross-sectional view of a horizontal deflection coil assembly.

FIG. 3 shows a horizontal deflection coil assembly which may be employed in the deflection yoke 1 according to the present invention. The horizontal deflection coil assembly shown in FIG. 3 has a plurality of spaced flanges 10, each identical to the plate 2i shown in FIG. 2, positioned in place of the respective fingers 2h on the ribs 2f for controlling the positions of the magnet wires. The structure shown in FIG. 3, however, suffers a disadvantage because a space, shown hatched, available for accommodating windings along the length C of the ribs 2f is reduced because of the flanges 10.

Figure 4:
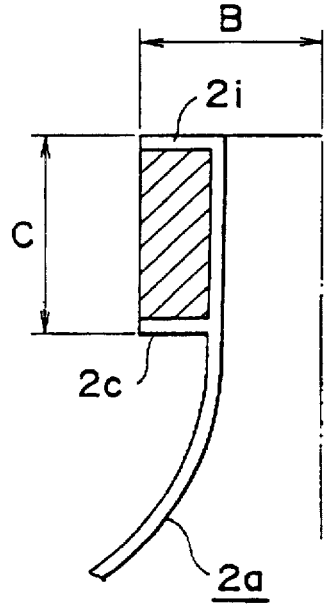
FIG. 4 is an enlarged fragmentary cross-sectional view of the horizontal deflection coil assembly shown in FIG. 2.

In the horizontal deflection coil assembly 2 according to the illustrated embodiment, as shown in FIG. 4, since the magnet wires are positionally controlled only at the opposite ends of their turns and no flanges 10 are employed, the horizontal deflection coil assembly 2 has a relatively large space, shown hatched, available for accommodating windings along the length C of the ribs 2f.

As a result, the outside diameter, represented by B in FIG. 4, of the deflection yoke 1 can be smaller than the outside diameter, represented by A in FIG. 3, of the deflection yoke with the flanges 10. The vertical deflection coil assembly 3 and the undivided core can thus be positioned closely to the neck of the cathode-ray tube.

The deflection yoke 1 is manufactured as follows: In the horizontal coil winding process, magnet wires are wound on the horizontal coil separator 2a to produce horizontal deflection coils. Specifically, a magnet wire is engaged by a front protrusion 2d, then placed in and directed along a groove 2g in the inner wall surface of the horizontal coil separator 2a to its rear end, and folded over at the rear end so as to extend around the cathode-ray tube, after which the magnet wire is placed in and directed along another groove 2g to another front protrusion 2d.

Turns of a horizontal deflection coil are bent over at respective positions staggered in the axial direction of the cathode-ray tube depending on the wound position of the magnet wire, by the ribs 2f which extend stepwise toward the neck of the cathode-ray tube along the inner wall surface of the horizontal coil separator 2a. The horizontal deflection coil thus formed has a bent section with a small outside diameter.

Since only the opposite ends of the bent turns of the magnet wire are controlled by the fingers 2h on the distal ends of the ribs 2f, the outside diameter of the bent section of the horizontal deflection coil is further reduced.

The horizontal deflection coil assembly 2 thus fabricated is inserted into the vertical deflection coil assembly 3, which is composed of an undivided core and a vertical deflection coil, through its front end opening. In this manner, the deflection yoke 1 is completed.

As described above, the turns of the horizontal deflection coil are bent over at respective positions staggered in the axial direction of the cathode-ray tube depending on the wound position of the magnet wire, and only the opposite ends of the bent turns of the magnet wire are controlled by the fingers 2h on the distal ends of the ribs 2f. Therefore, the outside diameter of the bent section of the horizontal deflection coil is reduced. Accordingly, the vertical deflection coil assembly 3 and the undivided core can thus be positioned closely to the neck of the cathode-ray tube for increased deflection sensitivity.

In the illustrated embodiment, the vertical deflection coil assembly is produced using the undivided core. However, the vertical deflection coil assembly may also be produced using a general divided core.

In the illustrated embodiment, the vertical deflection coil is wound integrally with the core. However, the vertical deflection coil may be wound separately from the core.

In the illustrated embodiment, the vertical deflection coil is fabricated as a sectionalized winding using the substantially funnel-shaped unitary vertical coil separator. However, the vertical deflection coil may also be fabricated as a toroidal vertical deflection coil. If a toroidal vertical deflection coil is desired, then the vertical and horizontal deflection coils can be produced using the horizontal coil separator as a common component, so that parts inventory control can be simplified.

Although a certain preferred embodiment of the present invention has been shown and described in detail, it should be understood that various changes and modifications may be made therein without departing from the scope of the appended claims.

What is claimed is:

1. A deflection system for use on a cathode-ray tube, comprising:

a vertical deflection coil assembly; and a horizontal deflection coil assembly inserted in said vertical deflection coil assembly, wherein said horizontal deflection coil assembly includes a substantially funnel-shaped horizontal coil separator and a horizontal deflection coil including turns wound as a sectionalized winding on said substantially funnel-shaped horizontal coil separator;

said substantially funnel-shaped horizontal coil separator having a plurality of ribs extending along an inner wall surface thereof facing a funnel of the cathode ray tube in an axial direction of the cathode-ray tube, said horizontal deflection coil being positionally controlled by contacting said ribs, said ribs projecting stepwise along the inner wall surface of said substantially funnel-shaped horizontal coil separator toward a neck of the cathode-ray tube whereat an annular flange is formed such that a central one of said plurality of ribs that is positioned centrally of said horizontal deflection coil projects a greater distance in the axial direction above said annular flange than lateral ones of said plurality of ribs on either side of said central one and said lateral ones projects a greater distance above said annular flange than end ones of said plurality of ribs on either side of said lateral ones, said ribs having fingers disposed on respective distal ends thereof and pointing radially outwardly at different projected heights above said annular flange so as to define an unobstructed space between said annular flange and said fingers whereat said turns of said horizontal deflection coil are accommodated.

2. A deflection yoke according to claim 1, wherein said ribs define grooves therebetween on said inner wall surface and said turns of said horizontal deflection coil are inserted in said grooves.

* * * * *